US006308392B1

(12) United States Patent
Mann et al.

(10) Patent No.: US 6,308,392 B1
(45) Date of Patent: Oct. 30, 2001

(54) BRITTLE WIRE MANUFACTURING METHOD AND APPARATUS

(75) Inventors: L. E. Mann, Cornelius, NC (US); R. E. Simon, Dayton, NV (US)

(73) Assignee: U.S. Welding International, Ltd., Nassau (BH)

( * ) Notice: Subject to any disclaimer, the term of this patent is extended or adjusted under 35 U.S.C. 154(b) by 0 days.

(21) Appl. No.: 09/351,465

(22) Filed: Jul. 12, 1999

(51) Int. Cl.[7] ..... B23P 17/00

(52) U.S. Cl. ..... 29/424; 29/423; 29/419.1; 228/141.1

(58) Field of Search ..... 29/423, 419.1, 29/424; 228/173, 141.1, 119, 227

(56) References Cited

U.S. PATENT DOCUMENTS 3,962,373 * 6/1976 Pertucelli ..... 260/900
3,994,428 * 11/1976 Li ..... 228/18
4,777,710 * 10/1988 Hunt ..... 29/419.1

* cited by examiner

*Primary Examiner*—S Thomas Hughes
*Assistant Examiner*—John C. Hong
(74) *Attorney, Agent, or Firm*—Herbert C. Schulze

(57) ABSTRACT

A method for making wire of brittle alloys including coating rods of the brittle alloy with refractory fluoride and organic polymer, loading the coated rods into a container, filling the container with metallic powder, sealing the container, heating the filled and sealed container, extruding the filled container into a diminished diameter and elongated length bar filled with reduced diameter wires, removing the container from the wires, and separating the wires. Alternatively continuously passing brittle alloy wire through a clamshell furnace, a liquid gas quench, roll reduction process, cleaning and polishing process, and final storage process.

2 Claims, 2 Drawing Sheets

BRITTLE WIRE MANUFACTURING METHOD AND APPARATUS

CROSS REFERENCE TO RELATED PATENT APPLICATIONS

There are no related pending patent applications filed by us.

BACKGROUND OF THE INVENTION

I. Field of the Invention

This invention is in the general field of manufacture of metallic wires;

The invention is more particularly in the field of manufacture of wire and other elongate members from high performance brittle alloys;

The invention is even more directly in the field of manufacture of such products by a specialized, novel, and unique version of the filled billet extrusion technique, and by a similarly novel and unique heat treating/cold roll system.

II. Description of the Prior Art

There is considerable prior art in this field. The following United States Patents reveal the state of the art prior to our present invention:

U.S. Pat. No. 4,209,122 discloses a method of making high performance alloy wire;

U.S. Pat. No. 3,788,820 discloses the making of high performance alloy members by the Filled Billet Extrusion Method;

U.S. Pat. No. 3,394,213 discloses the production of fine filaments through an interesting process involving some of the known extrusion processes and an acid solution process;

U.S. Pat. No. 4,606,884 combines a number of pressing, machining and acid solution steps;

U.S. Pat. No. 2,050,298 defines a process for reducing rods, wires, etc. by surrounding preforms with a brittle filler and performing a number of physical steps without using acid;

U.S. Pat. No. 4,209,122 defines a process to produce high performance alloy wires, etc. utilizing the principles set forth in many of the foregoing patents;

U.S. Pat. No. 4,777,710 includes the features of U.S. Pat. No. 4,209,122 particularly utilizing a chromium filler powder in the process.

SUMMARY OF THE INVENTION

High performance brittle alloy wires and the like are used extensively in various critical manufacturing processes and the like. They are particularly used in critical welding of various sensitive items, such as in aircraft welding and the like.

As will be understood by those skilled in the art, critical components must be addressed with the highest regard for performance and reliability since safety is a prime consideration. As a result, those engaged in production of high performance brittle alloy items are constantly seeking even the most minute improvement and innovation in manufacturing methods and the like.

We have previously mentioned some of the most important prior art in this field. Considering all of the innovations and improvements heretofore developed, we have still found deficiencies in the processes concerned.

The processes disclosed in U.S. Pat. Nos. 4,209,122; 3,394,213; and 3,505,039 are not efficient because the billets involved must contain a significant amount of filler at the expense of rod preforms. Also, where an acid solution is required to dissolve the filler an inordinate amount of time is involved.

The process of U.S. Pat. No. 3,788,820 is not efficient due to the high cost of producing lamina with desired perforations where needed which is prohibitive.

The process disclosed in U.S. Pat. No. 4,777,710 can be more effective and efficient for high performance wire manufacture than the other processes known to us. However, it, too, has deficiencies—primarily: 1) Performance of the glass coating on the preforms; and 2) Performance of the chromium filler powder around the preforms.

During preheating the glass particles coalesce to initially form a relatively uniform layer having truly liquid condition. This liquid condition, though, allows a significant portion of the glass to leave the surface of the preform rods and flow into the adjacent porous chromium filler powder due to gravity and capillary action. When the preforms no longer have the critical thickness of the protective coating of glass chromium atoms are able to diffuse into the surfaces of the preforms and the alloy constituents of the rods causing an undesirable alloy of sufficient thickness to require removal by centerless grinding. Also, variability of heating rates and times causes substantial variation of mechanical separation of the chromium, requiring manual separation of each strand. The overall result is a labor intensive process having an inherently low yield due to the centerless grinding of each strand of wire.

We have now conceived and perfected two methods for solving the problems concerned with the production of high performance brittle alloy wires.

1) In one of our methods we place brittle alloy rods coated with a slurry containing calcium fluoride and an acrylic polymer into a metal container which is specially treated as described and claimed below resulting in the ultimate efficiency of production and highest quality of the finished wire.

2) In our other method we feed brittle alloy wires through a high temperature clamshell furnace, into a liquid nitrogen quench, through a cold roll diameter reduction process and finally polish and solvent cleaning in special manner.

It is an object of this invention to provide improved and economical methods and means for manufacture of brittle alloy elongate shapes;

Another object of this invention is to provide such method and means wherein there is a minimum of lost product due to the necessity of machining of surfaces to eliminate contaminated material;

Another object of this invention is to minimize labor requirements in such method;

Another object of this invention is to maximize the quality of the brittle alloy products produced.

The foregoing and other objects and advantages of this invention will be clear to those skilled in the art upon reading the following description of preferred embodiments in conjunction with a review of the appended drawings.

DESCRIPTION OF A PREFERRED EMBODIMENT

Figure 1:
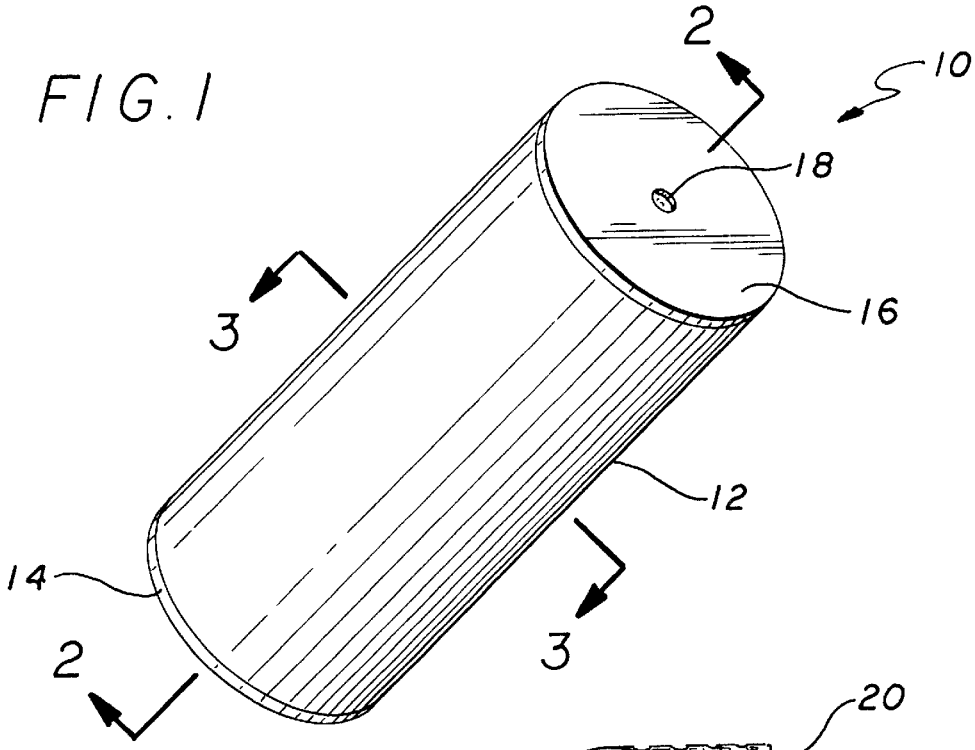
FIG. 1 is a perspective of a billet which has been created in the method of this invention.

The items having reference numerals in the drawings are:

| Numeral | Item |
|---|---|
| 10 | Billet |
| 12 | cylinder |
| 14 | bottom end cap |
| 16 | top end cap |
| 18 | vent |
| 20 | rod stop |
| 22 | cone |
| 24 | perforations |
| 30 | chromium powder |
| 32 | steel wool |
| 40 | rod bundle |
| 42 | rods |
| 51 | shim set |
| 52 | shim set |
| 53 | shim set |
| 54 | shim set |
| 55 | shim set |
| 56 | shim set |
| 100 | alternate embodiment generally |
| 102 | wire |
| 102a | reduced diameter wire |
| 102b | straight lengths of wire |
| 110 | payoff reel |
| 120 | clamshell oven |
| 130 | spray quenching |
| 132 | flow of residual nitrogen |
| 133–134 | nitrogen shield |
| 140 | roll reduction |
| 150 | polish and clean |
| 160 | take up reel |
| 165 | alternate final step |
| 170 | wire straightener/cutter |

This invention consists of improvements and innovations in the filled billet extrusion method, which method, prior to our present invention, is well known to those skilled in the art. For this reason and in the interests of expediency, full details of the filled billet extrusion method will not be detailed, but only those portions necessary for a complete understanding of the novel features of our invention. As a separate part of our invention we have provided an alternate method of producing brittle alloy wire continuously by a cold rolling wire forming method.

FIG. 1 illustrates a billet 10 consisting of elongate cylinder 12 (frequently referred to as a "can"), bottom end cap 14, and top end cap 16 with vent 18. The billet is ready for extrusion.

Figure 4:
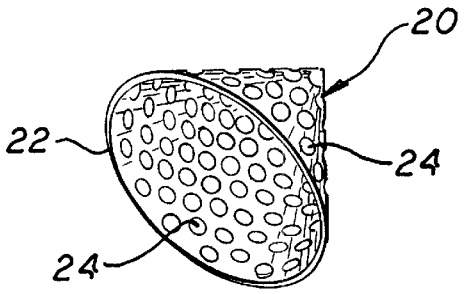
FIG. 4 is a perspective of a device used within the billet of FIG. 1.
Figure 2:
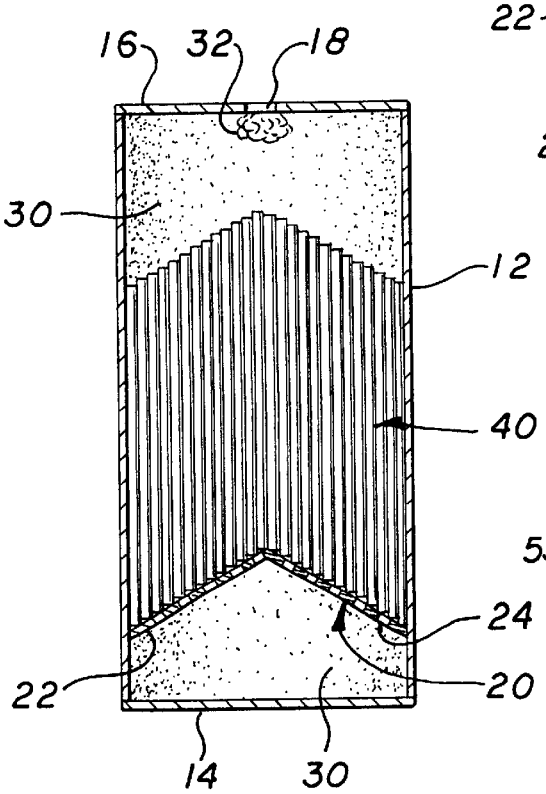
FIG. 2 is section on 2—2 on FIG. 1.
Figure 3:
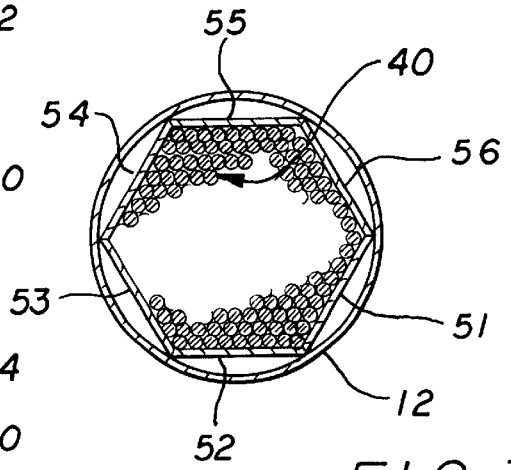
FIG. 3 is a section on 3—3 on FIG. 1.

FIGS. 2, 3, and 4 showing the contents of the billet are best viewed together.

As a preparatory step prior to placing anything in the cylinder, the rods are dipped in, or otherwise subjected to, a slurry of calcium fluoride and polymer, for example, acrylic copolymer emulsion in equal parts with water of sufficient quantity that the rods will have 2 to 3 mil thickness of slurry when dry. The inside of the can is also coated with the same slurry to the same thickness except that the rod stop 20 (a steel cone 22 with numerous perforations 24) and the interior end of the cylinder from the cap to the rod stop (about 2 inches) are wiped clean of the slurry, as is about one inch on the top end. The slurry has not been shown in the drawings.

The rod stop 20 and end cap 14 were originally fixed in position in cylinder 12 by welding or the like. The cylinder was then placed in a horizontal position. Shim sets 51, 52, and 53 were placed within the billet cylinder 12. A number of rods 40 were packed within the cylinder on the shim sets 51, 52, and 53. (shims are preferably in sets of three—that is one shim near each end of the rods and one in the center of the rods and in the same plane and orientation). Next the cylinder was rotated about 150°, shim set 54 was set within the cylinder and rods were packed until all rods which could be packed on the shim sets in the cylinder were in place. The rotation of the cylinder and the placement of shim sets and rods continued until all the rods which could be packed into the hexagonal arrangement on the shims were in place. At this point a decision was made to either remove the shim sets one by one and fill the voids thus created with rods or to leave the shim sets and the rods in the hexagonal configuration.

When all rods were in place, the cylinder was placed upright on a vibrator and chromium powder 30 was added while vibrating until chromium powder sifted through and around the entire bundle of rods 40 and filled the cylinder completely. A very small amount of chromium powder was removed from the center of the top and replaced by a small piece of steel wool or the like 32. The top end cap 16 is now welded in place with the vent 18 directly over the steel wool 32 which allows escape of fluids, but not the chromium powder. The complete billet 10 has now been formed.

The billet is now extruded. The heating cycles and the extrusion and cutting processes, etc. are known to those skilled in the art and are described in the patents referred to above. Therefore these processes will not be completely detailed here. We will outline the steps as follows:

1) The can is prepared as heretofore set forth;

2) Coating with slurry as set forth;

3) Arranging the rods for maximum density as set forth;

4) Filling with chromium metal powder;

5) Attaching a vented cap to form the billet;

6) The sixth step is unusual in that we preheat the billet in order to: a) Evolve moisture from the coatings; b) Pyrolyze the polymer; and c) Bring the entire billet assembly to a temperature which approximates the forging temperature of the preforms;

7) Extruding the billet into a bar;

8) Cooling the bar by water-quenching;

9) Cropping scrap from the front and rear ends of the bar;

10) Removing the extruded can from the bar;

11) Separating the wires from each other in a more efficient and improved manner than previous methods by reason of: a) The step of pyrolyzing the polymer is unique and very valuable in that at the lower temperatures during the heating as the polymer pyrolyzes carbonaceous gases are produced which carburize the chromium powder. This results in increasing the brittleness well beyond its inherent brittleness when not contaminated. The increased brittleness enhances the ease of mechanical separation of the wires; b) In the heating at a higher temperature the non-vitreous refractory fluoride does not undergo viscous flow into the interstices of the chromium powder, which maintains its properties as a parting agent, providing assurance of mechanical separation of the wire; c) At the highest temperature less diffusion across the parting agent occurs insuring separation ease by mechanical means; d) As a result, the separated wires have surfaces essentially uncontaminated by alloying by chromium or depletion in carbon; e) The separated wires generally do not require centerless grinding to remove a contaminated surface layer.

However, we must emphasize certain differences which make our new process truly unique, innovative, novel, and economical. Our slurry treatment of the individual rods and the interior of the cylinder is totally new. There have been attempts to do this—even recited in some of the patent references above—however, no one has previously come close to suggesting, or even hinting at the unusual, inventive, unique, novel and innovative combination of procedures and elements of our invention. We will enumerate certain unusual, novel and unique additional steps we take after extrusion and cropping of the extruded can.

One of the means by which we achieve great labor and cost saving is by rolling the can in a roll straightener. The roll straightener consists of a pair of rolls (generally somewhat oblong) operating at right angles to each other. Another rolling technique we employ is in a flat mill where the can is under pressure between two flat surfaces moving in opposite directions. These rolling techniques are known to those skilled in the art, but we believe we are the first to have conceived and developed these techniques in connection with can removal in the filled billet extrusion arts. We have found that we can enlarge the can circumference in this manner and either cut the can before or after rolling with the result that the can drops away leaving a solid bundle of wires with cracks between the wires which can then be acid rinsed economically.

Brittle wire produced by our method has a diffusion layer of 0.1 mil to 0.5 mil as compared to the methods previously disclosed by the referenced patents, particularly U.S. Pat. No. 4,777,710, which will have a typical diffusion layer of 0.5 mil to 2.0 mil. The result is that our method requires a minimum of centerless grinding or the like resulting in great savings as well as greater yield from a given starting volume of wire.

Figure 5:
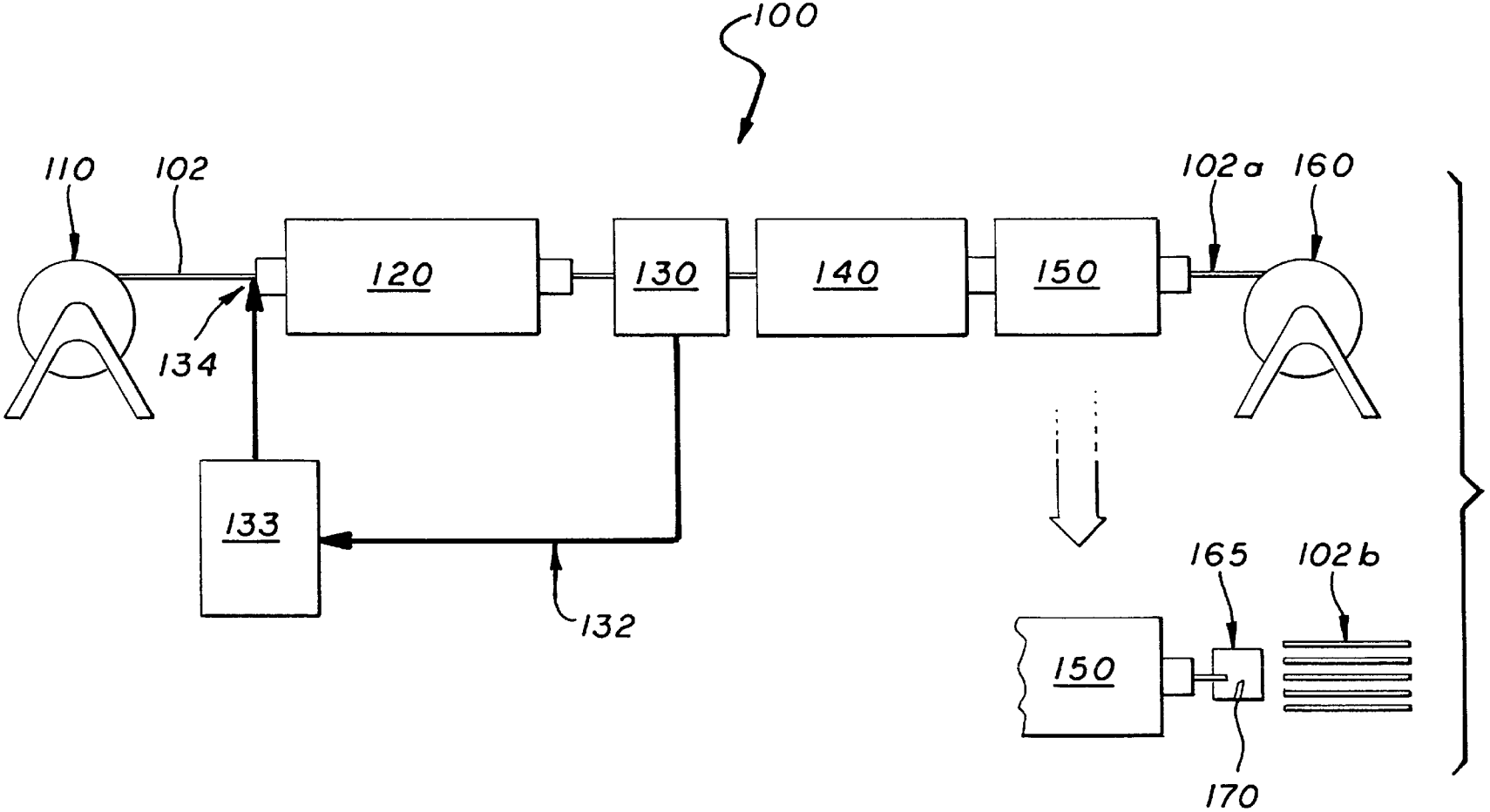
FIG. 5 is a schematic diagram of an alternate embodiment of the method of this invention.

FIG. 5 illustrates an alternate innovative, unique and novel method of producing brittle alloy wires in a continuous reduction system and procedure.

The entire process 100 utilizes a payoff reel 110 which carries brittle alloys wire 102. The wire 102 passes through the procedure hereafter described and is reeled onto take up reel 160 or is otherwise processed for ultimate use. This procedure of paying off the wire and ultimately taking it up will be understood by those skilled in the art. What is unique is the sequence of operations now described.

The wire 102 will be traveling through clamshell oven 120 at from 20 to 100 inches per minute at from 1800° F. to 2350° F. allowing a complete soak at the prescribed temperature.

The wire then proceeds on a continuous basis to liquid nitrogen (liquid argon or liquid helium may be used) spray quenching 130.

At 132 a flow of residual nitrogen is indicated which is used as a shield 133–134 at the wire intake.

At 140 the wire is cross rolled and reduced in diameter to the desired diameter in a cold demineralized bath.

At 150 the wire is polished and solvent cleaned.

At 160 the reduced wire 102*a* (up to 300% reduction of most brittle alloys, otherwise requiring the filled billet extrusion process) is finally spooled on a take up reel.

Alternately, the final step 165 may be cutting, by cut off means 170, into straight lengths of wire 102*b* or otherwise processed for use.

While the embodiments of this invention shown and described are fully capable of achieving the objects and advantages desired, it is to be understood that they have been shown for purposes of illustration only and not for purposes of limitation.

We claim:

1. A method of manufacturing elongate reduced diameter wires from elongate components of a larger diameter preforms comprising: coating a plurality of preforms with a mixture of calcium fluoride, acrylic copolymer, and water; filling a cylindrical container closed on one end with the coated preforms so as to achieve maximum density of the preforms; filling all available voids within the container with chromium powder; inserting a filtering material suitable to allow passage of fluids, but not chromium powder on top of the chromium powder at an open end of the container; attaching a vented cap to the open end of the container, thereby forming a billet; preheating the billet sufficiently to remove moisture from the coatings, pyrolyze the acrylic copolymer, and raise the entire billet to a forging temperature of the preforms; extruding the billet into a reduced diameter bar containing wires; cooling the bar; expanding the cylindrical container portion of the bar by rolling the bar under pressure; removing the expanded cylindrical container from the wires; and separating the wires.

2. The method of claim 1 in which the reduced diameter bar is quenched immediately after extrusion while still hot in order to create numerous fractures within the chromium.

* * * * *